United States Patent [19]

Doerge

[11] 4,274,450

[45] Jun. 23, 1981

[54] UNIVERSAL CLIP AND STRUCTURE FOR MAKING SAME

[75] Inventor: Gail W. Doerge, Kilgore, Tex.

[73] Assignees: Michael Andrew Sproles; Dennis Gary Decker; Rex Houston, all of Henderson; Larry Wayne Castleberry, Longview, all of Tex. ; part interest to each

[21] Appl. No.: 63,975

[22] Filed: Aug. 6, 1979

Related U.S. Application Data

[62] Division of Ser. No. 895,246, Apr. 10, 1978, abandoned.

[51] Int. Cl.[3] ..... B21F 45/16; B21F 45/22

[52] U.S. Cl. ..... 140/82; 140/123

[58] Field of Search ..... 140/82, 92.1, 102, 102.5, 140/104, 105, 106, 123, 124

[56] References Cited

U.S. PATENT DOCUMENTS

| | | | |
|---|---|---|---|
| 283,027 | 8/1883 | Scharf | 140/82 |
| 337,006 | 3/1886 | Mahon | 140/82 |
| 391,307 | 10/1888 | Ferguson | 24/260 |
| 483,320 | 9/1892 | Chamberlain | 140/102.5 X |
| 1,286,488 | 12/1918 | Amberg | 140/123 |
| 2,824,475 | 2/1958 | Rolando | 140/123 X |
| 3,804,132 | 4/1974 | Mann | 140/106 |

*Primary Examiner*—Richard B. Lazarus

*Attorney, Agent, or Firm*—Richards, Harris & Medlock

[57] ABSTRACT

The specification discloses a kit for making a universal clip. The kit includes a base having a horizontal top surface and a vertical side surface. Mounting apertures are disposed in the base for receiving fasteners to mount the base on support structure. A metallic cylinder and a pin extend upwardly from the top surface of the base spaced apart at a predetermined distance. The base also includes two horizontal bores of different bore depths and an oblique bore extending through the top and side surfaces for use in forming a tip on the universal clip. The universal clip is formed from a metallic wire that is wrapped around the cylinder to form a spring loop and forced against the pin to crook the wire to form two arms. A tip is formed on the end of each arm by bending the ends of the wire using the two horizontal bores in the base. The completed universal clip includes a loop spring portion, two arms, a tip portion, and a bushing encompassing the two arms and movable between a locked closed position and an open position.

4 Claims, 16 Drawing Figures

UNIVERSAL CLIP AND STRUCTURE FOR MAKING SAME

CROSS REFERENCE TO RELATED APPLICATIONS

This is a division of prior application Ser. No. 895,246, filed Apr. 10, 1978, now abandoned.

FIELD OF THE INVENTION

The present invention relates to tools for making clamping devices, and more particularly to tools for making a universal clip that locks in a closed position.

BACKGROUND OF THE INVENTION

Clamping devices that lock in a closed position are well known in the art. Applications for such locking clips range from doctors' surgical clips to cigarette clips to heat sink clips for use on an electronic test board. Such clips must provide a tight clamping grip when locked, and yet must be easily unlocked to enable removal of the gripped object. The present invention provides a universal locking clip which is easily and inexpensively manufactured and yet which provides improved clamping functions.

Wire bending kits of conventional design include a die cast aluminum jig; a heat treated, notched, cutting blade; long and short steel leverage bending tubes; and an assortment of hardened steel bending pins. Such a wire bending kit is manufactured by McMaster-Carr and sold under Model No. 9675K2. The jig of such kits can be fastened in a vise or mounted on a workbench. By using the bending pins mounted on the jig, or the slots in the jig, such parts as springs, clamps, conduit hangers and many other parts and devices can be made.

However, conventionally designed tools are not suited for rapid and convenient home manufacture of the universal clip of the present invention. The conventional tools are awkward for use by an unskilled consumer because the shape and position of the bends placed in the wire is determined by the skill of the user. There are no built-in features to predetermine the shape and position of each bend or crook in the wire necessary to form the universal clip. Also, the conventional bending tubes are not suited for making crooks near the end of a wire and will not accommodate a crooked or bent wire that requires additional shaping or bending. Thus, there has arisen a need for a kit suitable for home use designed for the easy and efficient manufacture of special purpose universal clips.

SUMMARY OF INVENTION

In accordance with the present invention, a kit is provided for manufacturing special purpose universal clips. The kit includes a substantially rectangular base having a horizontal top surface and at least one vertical side surface. Mounting apertures are disposed in the horizontal top surface extending through the base, and fasteners are provided for engaging the mounting apertures to mount the base on a work table. A metallic cylinder extends upwardly from the horizontal top surface of the base. A metallic pin is removably mounted on the top surface of the base and extends upwardly at a first predetermined distance from the cylinder. Two horizontal bores are provided extending through the vertical side surface of the base and having differing predetermined bore depths. Another bore extends at an oblique angle through the top and side surfaces.

To manufacture a special purpose universal clip, a metallic wire is provided having sufficient elastic and plastic material characteristics such that the wire may be plastically deformed by bending and yet the wire retains sufficient elasticity to function as a spring. The wire is first wrapped around the metallic cylinder to form a circular bend or loop spring portion in the wire such that the shape of such loop spring portion is determined by the shape of the cylinder. While the wire is wrapped around the cylinder, each end of the wire is forced against the metallic pin to form a first pair of crooks in the wire such that two wire arms extend from the loop spring portion. The position of the first pair of crooks is determined by the first predetermined distance between the cylinder and the pin.

A tip is formed on the ends of each arm by first inserting the end of the wires into the longer horizontal bore and crooking each end of the wire outwardly away from the other arm. Then, each wire end is inserted into the shorter horizontal bore and crooked inwardly towards the other wire arm. The shape of the tip and the position of each crook in the tip is determined by the bore depths of the two horizontal bores. Using a file provided in the kit, the ends of each wire are filed to form contact surfaces in an opposing substantially parallel relationship for grasping and holding objects. A bushing is provided for encompassing the arms of the clip and for moving between an open and a locked closed position.

To aid in bending and shaping the wire, a special Allen wrench is provided having shaped and slotted first and second ends being dimensioned to snugly receive and hold the wire during a bending operation. The ends of the Allen wrench are tapered to form two parallel surfaces on each end, with the surfaces on the first end of the wrench perpendicular to the surfaces on the second end. On both ends of the Allen wrench, a slot extends between the parallel surfaces. Two pairs of pliers are used for grasping and holding the wire during bending and crooking operations.

BRIEF DESCRIPTION OF THE DRAWINGS

The advantages and further aspects of the present invention will be readily appreciated by those of ordinary skill in the art as the same becomes better understood by reference to the following detailed description when considered in connection with the accompanying drawings in which.

DETAILED DESCRIPTION

Figure 1:
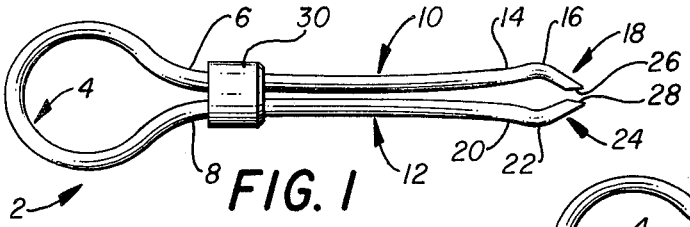
FIG. 1 is a side view of the universal clip of the present invention shown in an open position.

Referring now to the drawings wherein like reference characters designate like or corresponding parts throughout several views, there is shown in FIG. 1 a universal clip 2 of the present invention. The clip 2 is preferably made of a corrosive resistant metal wire such as brass having elastic and plastic material characteristics such that the wire may be plastically deformed by bending, but wherein the wire will maintain sufficient elasticity to function as a spring. The universal clip includes a spring loop portion 4 having two crooked portions 6 and 8 and a pair of arms 10 and 12 extending from the spring loop portion 4. The end of arm 10 includes a crook 14 extending the end of arm 10 in an outward direction. A crook 16 in the end of arm 10 extends the end of arm 10 back inwardly to form a tip portion 18 on the end of arm 10. Likewise, arm 12 includes a crook 20 and a crook 22 to form a tip portion 24 on the end of arm 12. Tip portions 18 and 24 include opposing, substantially parallel surfaces 26 and 28, respectively. These surfaces 26 and 28 form the contact or gripping surfaces of the universal clip 2.

The universal clip 2 also includes a corrosive resistant bushing 30 shown in FIG. 1 encompassing the arms 10 and 12 and disposed adjacent crooks 6 and 8 of the spring loop portion 4. The arms 10 and 12 are constantly urged apart by the spring force of spring loop portion 4. However, the bushing 30 encompasses and restrains the arms 10 and 12 in a substantially parallel relationship. In FIG. 1, the bushing 30 is disposed adjacent spring loop portion 4, and the clip 2 is in an open position. Thus, surfaces 26 and 28 are in an opposing, substantially parallel, spaced apart relationship.

Figure 2:
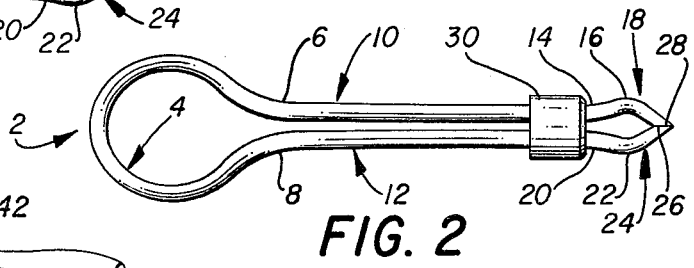
FIG. 2 is a side view of the universal clip of the present invention shown in a closed position.

Referring now to FIG. 2, the clip 2 is shown in a closed position. To close the clip 2, the bushing 30 is moved forward along arms 10 and 12 towards the tip portions 18 and 24. In a fully closed position, bushing 30 is disposed adjacent crooks 14 and 20. In this position, surface 26 contacts surface 28, and it is apparent that the shape of tip portions 18 and 24 will prevent the further forward movement of bushing 30 towards tip portions 18 and 24. As bushing 30 moves along arms 10 and 12 towards tip portions 18 and 24, surfaces 26 and 28 will be forced inwardly, each surface towards the other surface. In this manner, an object may be grasped between surfaces 26 and 28.

Figure 3:
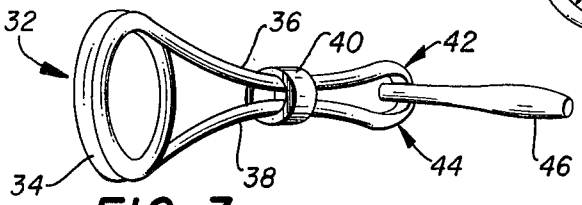
FIG. 3 is a perspective view of an alternate embodiment of the universal clip having a double loop spring portion and shown grasping an object.

Referring now to FIG. 3, a universal clip 32 is shown representing an alternate embodiment of the universal clip of the present invention. Clip 32 includes a double loop spring portion 34 with arms 36 and 38 extending outwardly therefrom. The bushing 40 encompasses arms 36 and 38, and a tip portion 42 and 44 is formed on the ends of each arm 36 and 34, respectively. An object 46 has been disposed between tip portions 42 and 44, and bushing 40 has been moved outwardly along arms 36 and 38 away from double loop spring portion 34 causing the tip portions 42 and 44 to grasp the object 46. In this manner, the universal clip 32 may be locked in a position to continuously grasp the object 46.

Figure 4:
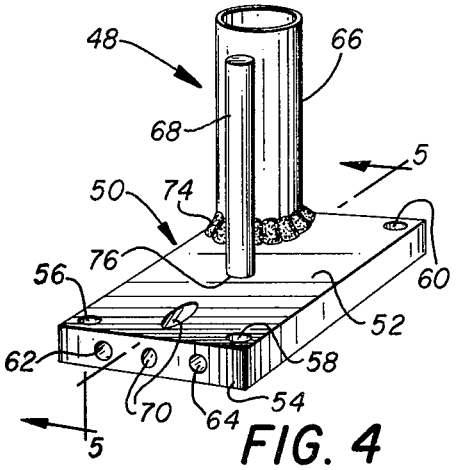
FIG. 4 is a perspective view of the universal clip tool of the present invention having a base with a cylinder and a pin extending upwardly therefrom.

Referring now to FIG. 4, a universal clip tool 48 is shown for making universal clips. The tool 48 is constructed of a strong rigid material such as steel and includes a base 50 having a horizontal top surface 52 and a front vertical side surface 54. Three substantially vertical mounting apertures, 56, 58 and 60 are formed in base 50 extending through the horizontal top surface 52. Two horizontal bores 62 and 64 extend into base 50 through the vertical side surfaces 54 and may be used for forming tip portions 18 and 24 on the universal clip 2 shown in FIG. 1 as will be hereinafter described in more detail.

A cylinder 66 is welded to the horizontal top surface 52 of the base 50 and extends in an upward vertical direction therefrom. A pin 68 is removably attached to base 50 and also extends in an upward vertical direction from the top surface 52. Pin 68 and cylinder 66 are substantially parallel and spaced apart at a predetermined distance. Cylinder 66 may be used for forming the loop spring portion 4, and the pin 68 is used for placing crooks 6 and 8 in the clip 2, as will be hereinafter described in detail.

The base 50 also includes a bore 70 extending at an oblique angle through the horizontal top surface 52 and the vertical side surface 54. Bore 70 is dimensioned to receive the wire suitable for making the universal clip 2. Bore 70 is useful for general purpose bending and shaping of the universal clip 2 during the manufacturing process. Since bore 70 extends completely through the base 50, a wire may be inserted through the bore 70 and positioned to place a bend at any point along the wire.

Figure 5:
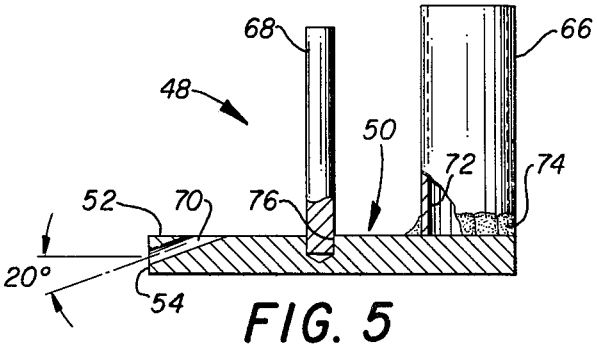
FIG. 5 is a cross section of the universal clip tool taken through plane 5—5 in FIG. 4.

Referring now to FIG. 5, a cross section view of the universal tool 48 is shown as indicated by plane 5—5 in FIG. 4. Cylinder 66 is shown partially cut away to reveal that, in the preferred embodiment, the cylinder wall 72 is approximately 1/16 of an inch thick. The cylinder 66 is welded to base 50 producing a weld joint 74.

A pin bore 76 extends approximately 3/16 of an inch partially through base 50 normal to horizontal top surface 52 and is dimensioned to snugly receive pin 68. The pin 68 may be removably mounted on base 50 by inserting the pin 68 into the pin bore 76. Thus, the position of pin bore 76 at a predetermined distance from the cylinder 66 determines the position of pin 68.

The cross section in FIG. 5 reveals the bore 70 in base 50 extending through vertical side surface 54 and horizontal top surface 52. Bore 70 extends through the approximate center of surface 54 and is inclined upwardly at an angle of 20 degrees such that bore 70 intersects surface 52. By extending a wire into bore 70 at surface 54 and out of bore 70 through surface 52, the wire may be positioned for bending and shaping at an any point along the wire.

Figure 6:
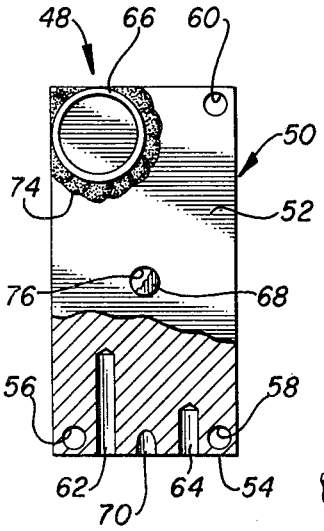
FIG. 6 is a partially sectioned top view of the universal clip tool for making a universal clip.

Referring now to FIG. 6, the end of base 50 is shown partially cut away to reveal the bore depths of horizontal bores 62 and 64. Bore 62 is approximately 11/16 of an inch deep, and bore 64 is approximately 5/16 of an inch deep. These bore depths are important in shaping the tip portions 18 and 24 of the universal clip 2 as will be hereinafter described in more detail.

As best shown in the plan view of universal tool 48 in FIG. 6, the pin bore 76 is centered at a predetermined distance, preferably ¾ of an inch, from the cylinder 66. The positioning of pin bore 76 determines the distance between pin 68 and cylinder 66. This positioning of pin 68 relative to cylinder 66 is important for properly placing the crooks 6 and 8 in the universal clip 2 as shown in FIG. 1.

Figure 7:
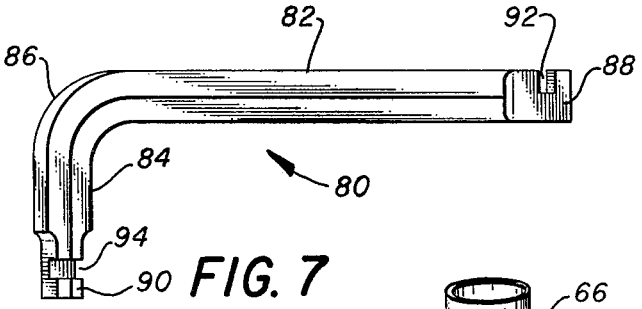
FIG. 7 is a perspective view of the slotted wrench of the present invention used for bending wire.

Referring now to FIG. 7, a wire bending wrench 80 is shown. Wrench 80 includes two perpendicular, hexagonal, substantially cylindrical shafts 82 and 84 connected at their respective ends by a curved portion 86. The distal ends of wrench 80 are shaped to form two parallel surfaces of which surfaces 88 and 90 are shown in the perspective view of FIG. 7. The planes of surfaces 88 and 90 are perpendicular. Extending through and perpendicular to surface 88 is a slot 92. Likewise, extending through and perpendicular to surface 90 is a slot 94. The two slots, 92 and 94, are dimensioned to snugly receive the wire used to make the universal clip 2, and the slots are useful in bending the wire as will be hereinafter described in detail.

Figure 8:
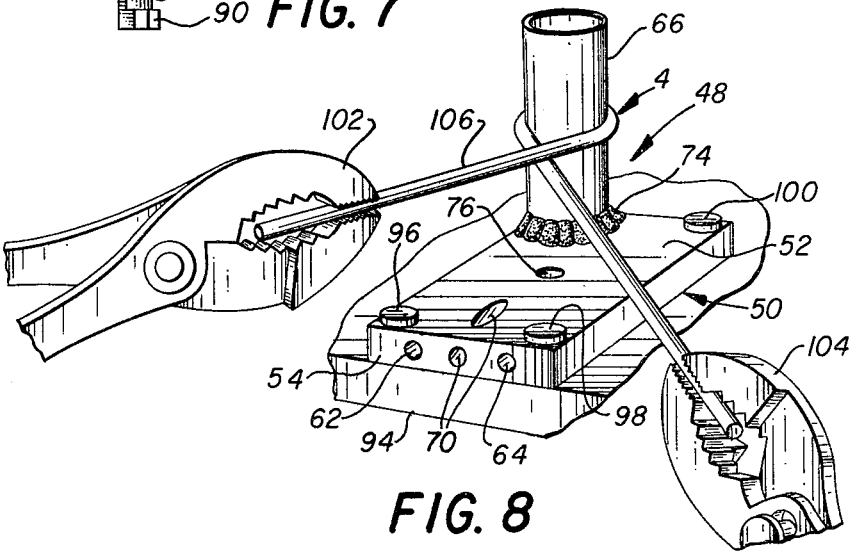
FIG. 8 is a perspective view of the universal clip tool shown forming a loop spring portion in a wire.

Referring now to FIG. 8, the first step in the manufacture of a universal clip is shown. In FIG. 8, the universal tool 48 is shown fastened to a workbench 95 by fasteners such as nails 96, 98 and 100 extending through mounting apertures 56, 58 and 60. Using pliers 102 and 104 to grip the ends of a wire 106, the wire is wrapped around cylinder 66 and criss-crossed. This step forms the loop spring portion 4 of the universal clip 2.

Figure 9:
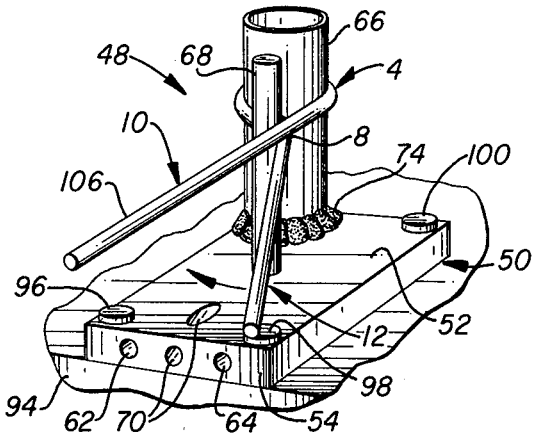
FIG. 9 is a perspective view of the universal clip tool shown placing a crook in a wire to form a first arm of the universal clip.
Figure 10:
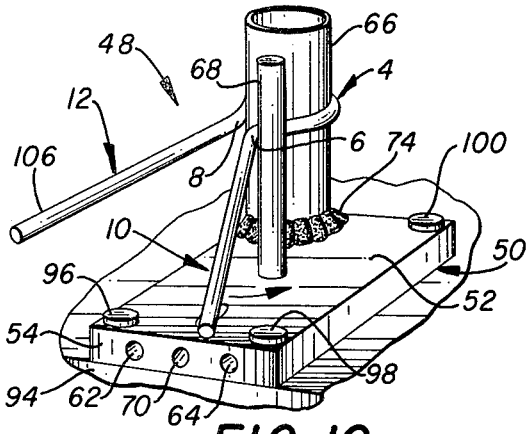
FIG. 10 is a perspective view of the universal clip tool shown placing a second crook in a wire to form a second arm of the universal clip.
Figure 12:
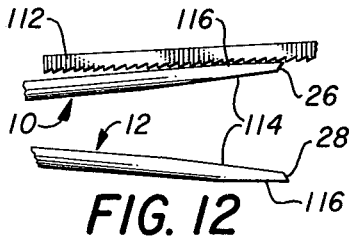
FIG. 12 is a detail view of the tip portion of the universal clip showing a file for forming and shaping the tip portions.

Referring now to FIGS. 9 and 10, the universal tool 48 is shown with pin 68 mounted on the base 50. A crook 8 is placed in wire 106 by forcing the wire 106 against pin 68 while the wire 106 is wrapped around the cylinder 66. The pin 68 is then removed and the wire 106 is rotated clockwise around cylinder 66, and the pin 68 is replaced. Then, the wire 106 is forced against pin 68 in the opposite direction to form the crook 6.

Figure 11:
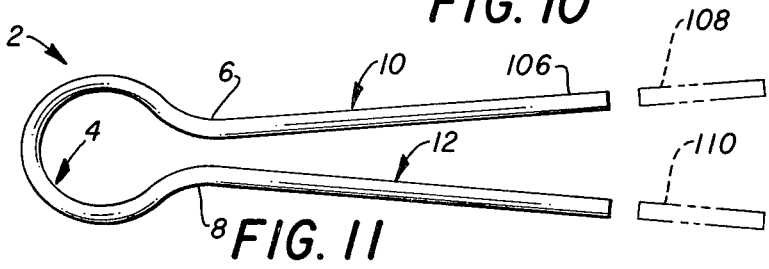
FIG. 11 is a side view of a partially manufactured universal clip showing the ends of the clip evened and cut away.
Figure 14:
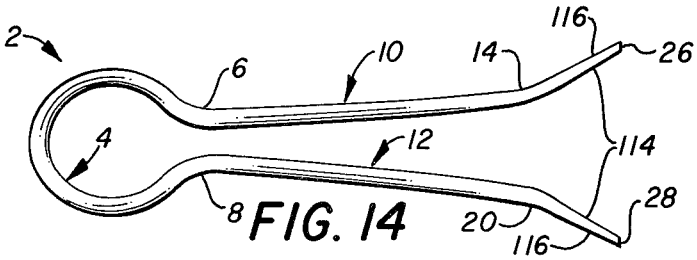
FIG. 14 is a side view of a partially manufactured universal clip having crooked tip portions extending in an outward direction.

Referring now to FIG. 11, the wire 106 appears as it would after the above crooking operations having a spring loop 4 with arms 10 and 12 extending therefrom. Next, the wire portions 108 and 110 are cut from wire 106 in a conventional manner such that arms 10 and 12 are of the same length. The ends of arms 10 and 12 are then shaped and formed using a file 112. Tapered flat inside surfaces 114 and outside surfaces 116 are filed on each end of arms 10 and 12. Contact surfaces 26 and 28 also are filed on the ends of arms 10 and 12 angled inwardly at approximately 45 degrees with respect to each arm.

Figure 13:
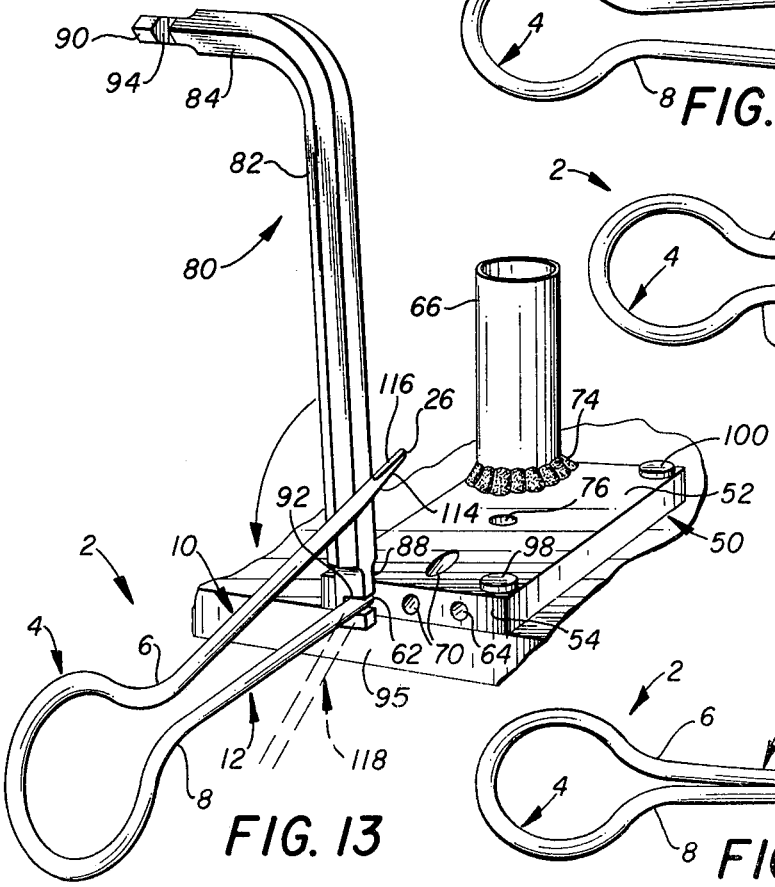
FIG. 13 is a perspective view of the universal clip tool and the slotted wrench being used to crook the tip portion of the universal clip.

Referring now to FIGS. 1 and 13, the arms 10 and 12 are sequentially inserted into bore 62 to make the crooks 14 and 20 in tip portions 18 and 24 of the clip 2. Using slot 92 of wrench 82 to grasp arm 12, the arm 12 is bent downwardly into the position indicated by dotted lines 118. Then arm 10 is inserted into bore 62 and the bending operation is repeated. In this manner, crooks 14 and 20 are placed in arms 10 and 12 of the universal clip 2. The position of crooks 14 and 20 is controlled by the depth of bore 62. By forcing both arms 10 and 12 to the end of bore 62, the crook may be placed in both arms at a distance of 11/16 of an inch from the ends of the arms.

Figure 15:
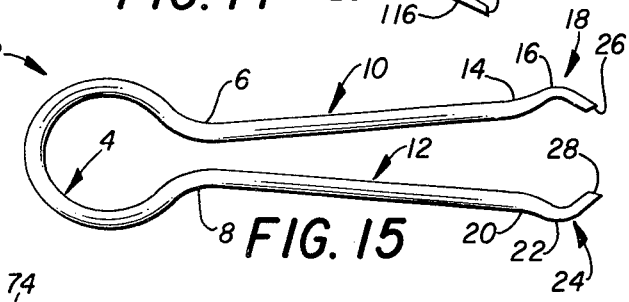
FIG. 15 is a side view of a universal clip having completely manufactured tip portions.

The crooks 16 and 22 are formed in a similar manner. The ends of arms 10 and 12 are placed sequentially in bore 64 and forced to the end of the bore. Then each of arms 10 and 12 are bent inwardly using wrench 80. The exact position of crooks 16 and 22 is 5/16 of an inch from the ends of arms 10 and 12, respectively. This positioning is determined by the bore depth of bore 64. After the above procedure, tip portions 18 and 24 are completed as shown in FIG. 15.

Figure 16:
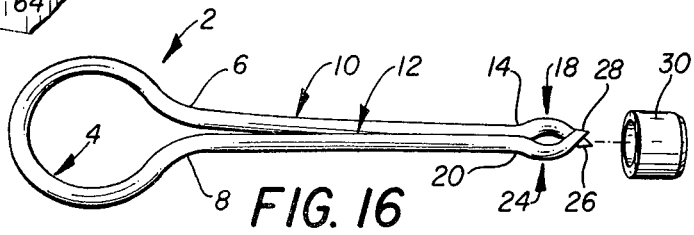
FIG. 16 is a side view of a universal clip and bushing showing the clip in position for receiving the bushing.

Referring now to FIG. 16, the universal clip 2 is shown in the final stage of assembly. The arms 10 and 12 are pressed together and skewed sideways such that the two arms slightly overlap and the tip portions 18 and 24 are positioned side by side. In this position the tip portions 18 and 24 may be inserted through the bushing 30 to place bushing 30 on arms 10 and 12. After the bushing has been placed in its proper position on the universal clip 2, the arms 10 and 12 will spring outwardly and realign themselves such that upon compression the tip portions 18 and 24 will be disposed in an opposing relationship. When the arms 10 and 12 are pressed together and not skewed, the tip portion 18 will engage the tip portion 24. In this position the tip portions 18 and 24 will not pass through bushing 30, as best shown in FIG. 2. In this manner, bushing 30 is retained on universal clip 2.

Although particular embodiments of the present invention have been described in the foregoing detailed description, it will be understood that the invention is not limited to the embodiments disclosed, but is capable of numerous rearrangements, modifications, and substitution of parts and elements without departing from the spirit of the invention.

What is claimed is:

1. A kit for mounting on a work table for making a universal clip comprising:

a substantially rectangular base having at least one horizontal top surface and at least one vertical side surface, said base having mounting apertures disposed in said horizontal top surface and extending through said base;

structure engaging the mounting apertures to mount said base on the work table;

a metallic wire of a predetermined diameter having sufficient plastic and elastic material characteristics to function as a loop spring and be plastically deformed by bending, said wire for being bent and shaped to form the universal clip;

a metal cylinder extending upwardly in a vertical direction from the horizontal top surface of said base and being dimensioned to form a loop spring portion in said wire by wrapping said wire once around said cylinder;

a substantially vertical bore of a first bore depth in the horizontal top surface and extending partially through said base at a first predetermined distance from said cylinder;

a metallic pin disposed in said bore and extending upwardly from the horizontal top surface of said base at the first predetermined distance from said cylinder such that said wire when wrapped around said cylinder may be forced against said pin to place a first pair of crooks in said wire to form two arms extending from the loop spring portion in the wire, the position of the first pair of crooks being determined by the first predetermined distance between said cylinder and said pin;

a second bore of a second bore depth extending in a substantially horizontal direction through the vertical side surface of said base, said second bore being dimensioned to receive the ends of the wire to form a second pair of crooks to extend each end of the wire outwardly such that the end of each of the two arms extends away from the other arm, the position of said second pair of crooks being determined by the second bore depth of said second bore;

a third bore of a third predetermined depth extending in a substantially horizontal direction through the vertical side surface of said base, said third bore being dimensioned to receive the ends of the wire to form a third pair of crooks to extend each end of the wire inwardly such that the ends of each of the two arms extends towards the other arm, the position of said third pair of crooks being determined by the depth of said second bore; and a fourth bore extending at an oblique angle through the horizontal top surface and the vertical side surface of the base, said bore being dimensioned to receive said wire for shaping and bending said wire at any point along the wire to form said clip.

2. The kit as set forth in claim 1 further comprising:

a wrench having shaped and slotted ends being dimensioned to snugly receive said wire into one of the slotted ends for use in bending said wire when disposed in said second and third bores.

3. The kit as set forth in claim 1 wherein:

two pairs of pliers are used for bending and shaping said wire.

4. The kit as set forth in claim 1 further comprising:

a bushing for encompassing said wire after it has been bent and shaped to form said clip, said bushing being operable to move between an open and closed position on the clip.

* * * * *